US005090226A

United States Patent [19]

Takeoka et al.

[11] Patent Number: 5,090,226

[45] Date of Patent: Feb. 25, 1992

[54] MOTOR DRIVEN FLARING DEVICE

[75] Inventors: Katsushi Takeoka, Ikoma; Tsuyoshi Ohashi, Nagoya; Yoshiharu Ikenaka, Higashiosaka, all of Japan

[73] Assignees: Rex Industries Co., Ltd., Osaka; Inoac Corporation, Aichi, both of Japan

[21] Appl. No.: 665,461

[22] Filed: Mar. 6, 1991

[30] Foreign Application Priority Data

Mar. 15, 1990 [JP] Japan ..... 2-62714

[51] Int. Cl.[5] ..... B21D 41/02

[52] U.S. Cl. ..... 72/117; 72/125; 408/132

[58] Field of Search ..... 72/115, 117, 124, 125; 408/132, 137

[56] References Cited

U.S. PATENT DOCUMENTS 1,946,214 2/1934 Kabigting ..... 408/137
2,893,464 7/1959 Franck ..... 72/117
3,040,800 6/1962 Hartley ..... 72/124
4,831,855 5/1989 Wagner ..... 72/125

*Primary Examiner*—Lowell A. Larson
*Attorney, Agent, or Firm*—Merchant, Gould, Smith, Edell, Welter & Schmidt

[57] ABSTRACT

A motor driven flaring device in which a rotatable eccentric cone an apex of which defines a fixed center of rotation is pressed, while rotating, against an end of a pipe to be flared, including a body having a motor incorporated therein and having an output shaft to be connected to a drive source, a rotational drive shaft connected to the output shaft of the motor so as to relatively move in the axial direction thereof, a feed screw shaft member connected to the rotational drive shaft and screw-engaged by the body so as to rotate and move in the axial direction thereof, and a one-direction rotation transmission mechanism between the rotational drive shaft and feed screw shaft member for transmitting the rotation of the rotational drive shaft to the feed screw shaft member only in one direction.

18 Claims, 11 Drawing Sheets

START

START

COMPLETION OF FLARING

IDLING

IDLING AT REVERSE ROTATION

COMPLETION OF FLARING

IDLING

IDLING AT REVERSE ROTATION

MOTOR DRIVEN FLARING DEVICE

BACKGROUND OF THE INVENTION

1. Field of the Invention

The present invention relates to a flaring tool for gradually spreading a front end of a pipe into a conical shape, and more particularly, it relates to a motor driven flaring device.

Upon welding or fusing a pipe to another pipe or a pipe coupling, it is necessary to spread an end of the pipe or the pipe coupling to be connected to the pipe from an inner diameter side thereof into a conical shape in order to provide a sufficient connecting surface area. To this end, a flaring device can be used.

2. Description of the Related Art

To spread a pipe end into a conical shape (e.g., 45° flare), as shown in FIG. 15, a simple manual flaring tool has been used having a tool body 1 which has a rotatable shaft 7 with handle 3 at its upper end, as shown in FIG. 12. The rotatable shaft 7 is rotatably screwed in the upper end of the tool body 1. The rotatable shaft 7 is provided on its lower end with an eccentric cone 5, as shown in FIGS. 13 and 14. Upon flaring, the eccentric cone 5 is pressed against the end of the pipe P and then the handle 3 is manually rotated by an operator to rotate the eccentric cone 5 while pressing the eccentric cone 5 down onto the pipe end to thereby spread the latter into a conical shape. Thus, the pipe end is flared from the inner diameter side thereof into a conical shape corresponding to the eccentric cone 5.

As can be seen in FIGS. 13 and 14, a rotation axis Y of the eccentric cone 5 about which it rotates is inclined or eccentric with respect to the axis X of the rotatable shaft 7. However, the center of rotation of the eccentric cone 5 at the front end thereof (apex of the cone) is fixed and is always located on the axis of the rotatable shaft 7, so that the pipe end can be gradually and smoothly flared. Note, there is a phase difference of 180° of the eccentric cone 5 between FIGS. 13 and 14.

In FIGS. 13 and 14, numeral 9 designates a holder plate which holds the pipe P and has an array of holes 6 in which the pipe P to be held is inserted. In the arrangement shown in FIGS. 13 and 14, although there are six different diameters of holes 6 (only three of them are shown) in which six outer diameters of pipes can be selectively inserted and held, only one hole 6 could be essentially formed in the holder plate 9. The holes 6 are chambered or tapered at the entrance ends thereof into a conical shape corresponding to the conical peripheral surface of the eccentric cone 5.

The holder plate 9 is split into two plate elements **9*a* and 9*b* (FIG. 12), each having semi-circular recesses defining the holes 6 when combined. The pipe P is first fitted in the associated hole 6 and is then firmly held therein by the holder plate 9 when a threaded handle 8 attached to the tool body 1** is fastened.

In a known manual flaring tool as mentioned above, the operator must manually rotate the handle 3 with a large operational force, which is however troublesome and inconvenient. In particular, upon flaring an end of an existing pipe which runs along a ceiling of a house, the operator is obliged to work while looking above, which is often physically not acceptable.

Furthermore, the precision of the flaring largely depends on the skill of the operator because of the manual operation, thus resulting in a loss of reliability.

SUMMARY OF THE INVENTION

The primary object of the present invention is to provide a simple motor driven flaring device which can eliminate the above-mentioned drawbacks of the prior art.

To achieve the object mentioned above, according to the present invention, there is provided a motor driven flaring device in which a rotatable eccentric cone an apex of which defines a fixed center of rotation is pressed, while rotating, against an end of a pipe to be flared to spread the end of the pipe into a conical shape, comprising, a body having a motor incorporated therein and having an output shaft to be connected to a drive source, said body being provided with a female threaded portion, a rotational drive shaft which is connected to the output shaft of the motor so as to relatively move in the axial direction thereof, said eccentric cone being rigidly secured to the rotational drive shaft, a feed screw shaft member which is connected to the rotational drive shaft and is screw-engaged by the female threaded portion of the body so as to rotate and move in the axial direction thereof, a one-direction rotation transmission means between the rotational drive shaft and the feed screw shaft member for transmitting the rotation of the rotational drive shaft to the feed screw shaft member only in one direction, and an elastic means between the feed screw shaft member and the rotational drive shaft for continuously biasing the rotational drive shaft in one predetermined axial direction.

Preferably, the motor is located below the rotational drive shaft so that the output shaft of the motor is substantially in parallel with the rotational drive shaft.

Preferably also, a clutch member is provided between the rotational drive shaft and the feed screw shaft member to selectively disengage the connection therebetween through the one-direction rotation transmission means in accordance with the axial movement of the feed screw shaft member.

It is possible to provide a pipe holder which can be detachably attached to the body of the device to releasably hold a pipe to be flared.

Preferably, a positioning plate is provided, which is rotatably mounted to one of the split plates to restrict the axial position of a pipe to be flared in the pipe holder.

The eccentric cone itself is similar to that of the prior art shown in FIGS. 13 and 14. The axis of the rotation of the eccentric cone is inclined with respect to the axis of the rotational drive shaft, but the apex of the cone which defines a fixed center of rotation is immovably located on the axis of the rotational drive shaft.

The eccentric cone is rotated by the motor at a predetermined number of revolutions reduced by the reduction gear device. Upon flaring, when the rotational drive shaft rotates, the rotation thereof is transmitted to the feed screw shaft, so that the later moves in the axial direction through a feed screw mechanism which is constituted by the female and male threads formed on the body and the feed screw shaft, respectively. The axial movement of the feed screw shaft is transmitted to the rotational drive shaft, and accordingly, to the eccentric cone through the elastic means, so that the eccentric cone is moved in the same axial direction. As a result, the eccentric cone is strongly pressed against the end of the pipe to be flared while rotating to spread the pipe end into a conical shape.

Upon completion of the flaring, the eccentric cone is no longer able to move in the axial direction, so that it idles in the pipe end. Accordingly, a further rotation of the motor causes the feed screw shaft to move further in the axial direction while compressing the biasing means, so that the connection of the rotational drive shaft and the feed screwshaft is broken, thus resulting in a null operation of the one-direction rotation transmission means. The idle rotation of the eccentric cone after the completion of the flaring prevents the tool, i.e., the eccentric cone from being damaged or broken due to the overload and also contributes to production of a uniform and precisely flared end of the pipe.

If the motor is located below the rotational drive shaft so that the output shaft of the motor is in parallel with the rotational drive shaft, the flaring device can be made compact and handy.

The engagement and disengagement of the one-direction rotation transmission means are effected by the clutch member.

The pipe to be flared can be easily attached to the flaring device using the pipe holder. The pipe can be easily and definitely positioned at a predetermined position of the pipe holder by inserting the pipe in the pipe holder until the pipe end comes into surface contact with the side face of the positioning plate, so that no positioning of the pipe depends on the operator's intuition.

BRIEF DESCRIPTION OF THE DRAWINGS

The invention will be described below in detail with reference to the accompanying drawings, in which.

DESCRIPTION OF THE PREFERRED EMBODIMENTS

Figure 1:
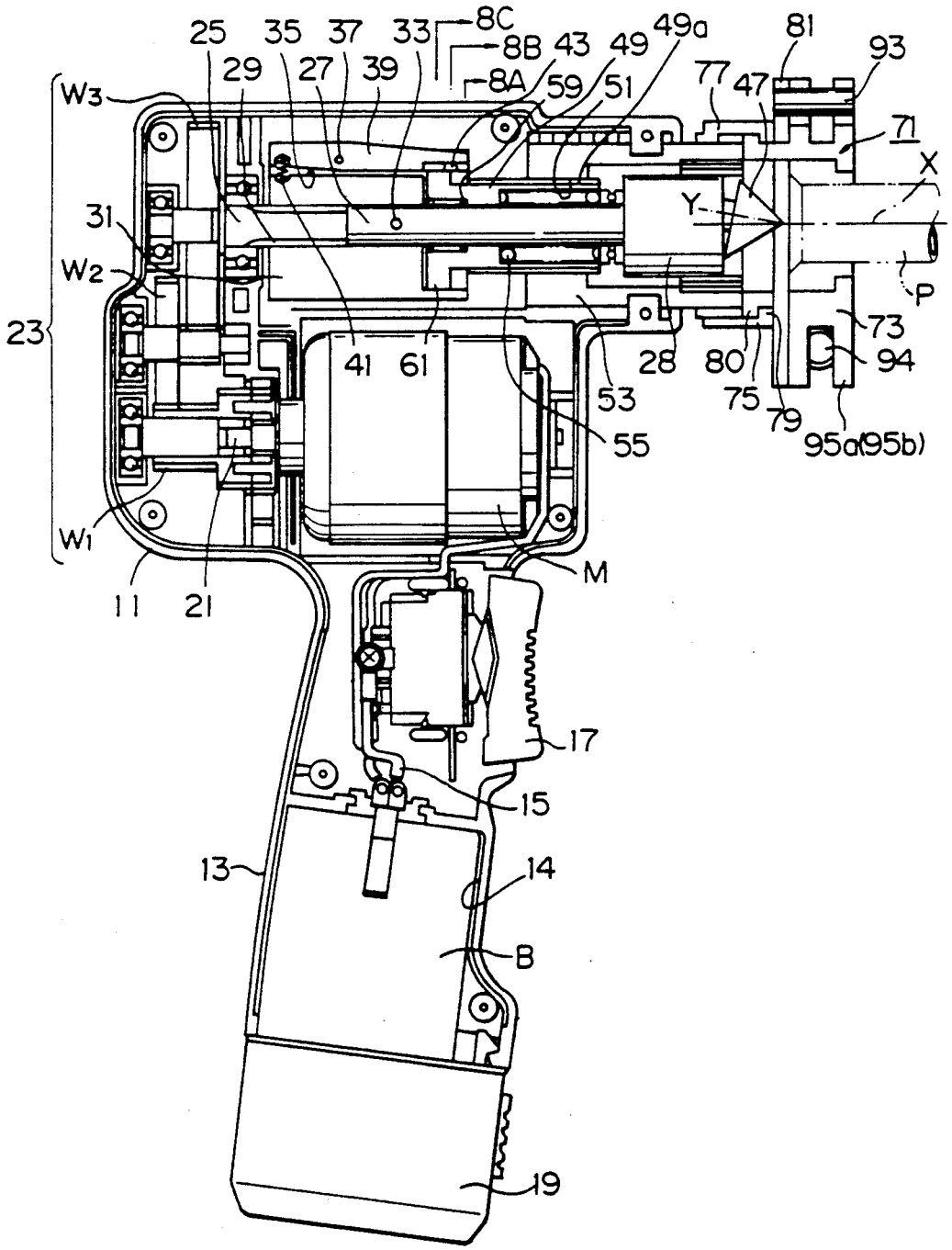
FIG. 1 is a longitudinal sectional view of a motor driven flaring device according to the present invention.
Figure 2:
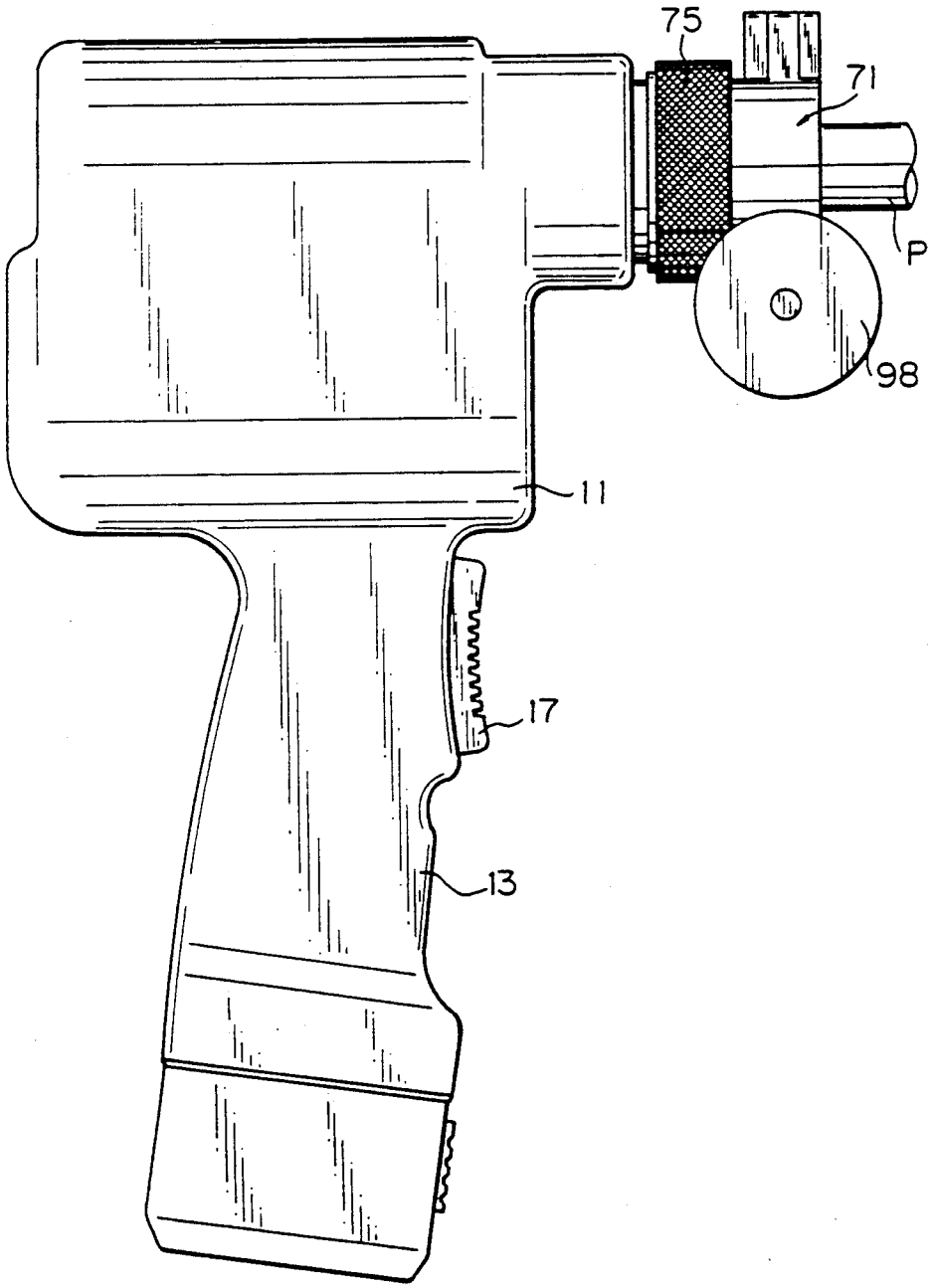
FIG. 2 is a front elevational view of an appearance of a motor driven flaring device, shown in FIG. 1.
Figure 3:
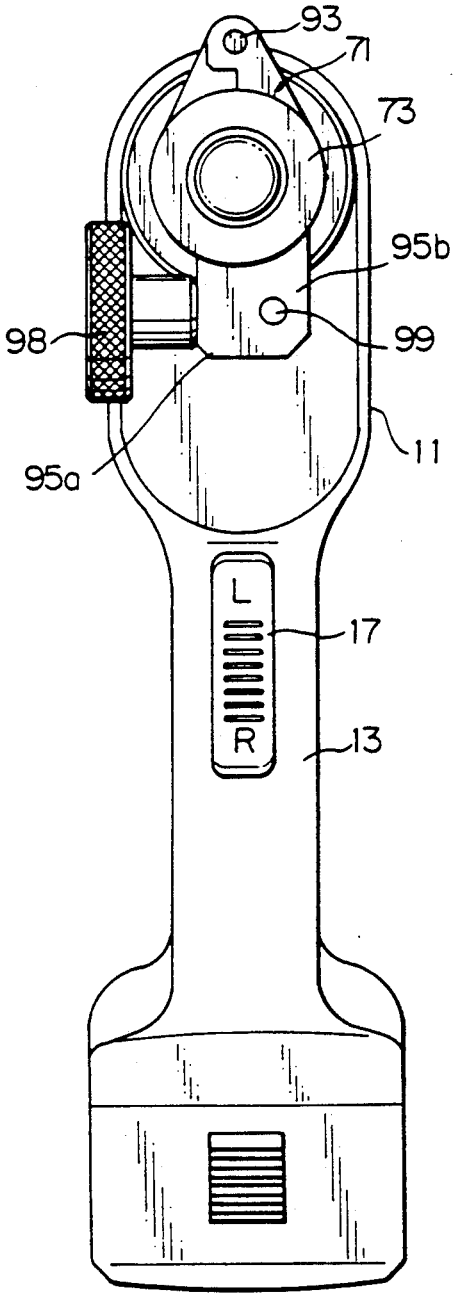
FIG. 3 is a right side elevational view of a motor driven flaring, device shown in FIG. 2.

FIGS. 1, 2, and 3 show an embodiment of a motor driven flaring device according to the present invention.

The flaring device has a pistol-shaped body 11 having a grip portion 13 which is provided on its lower portion with a battery receptacle 14 in which a battery B is received. The battery B is connected to a motor M incorporated in the body 11 by means of a cord 15 through a drive switch 17. When the upper end and the lower end of the drive switch 17 which corresponds to a trigger of a pistol are pushed down, the motor M is rotated in the left (L) and the right hand (R) directions, respectively, as shown in FIG. 3. The drive switch 17 is automatically made OFF when the operational force is released therefrom. The battery B can be removed from the battery receptacle 14 for exchange by opening a bottom cover 19 provided at the lower end of the body 11.

The motor M is disposed above the upper end of the grip portion 13 in the body 11. The motor M has an output shaft 21 which is connected to a rotational drive shaft 27 through a reduction gear device 23 which is composed of a gear train including a certain number of gears W1, W2, W3, etc., which are rotatably supported by respective bearings. The rotational drive shaft 27 has an annular boss 31 which is connected to a gear shaft 25 of the terminal end gear W3 of the reduction gear device 23 through a spline 29, so that the rotation of the motor M is reduced and transmitted to the rotational output shaft 27. The annular boss 31 is made integral with the rotational drive shaft 27 by a knock-pin 33.

The annular boss 31 is provided on its outer peripheral surface with an axial groove 35 which extends in the axial direction, so that a ratchet lever 39 which constitutes a one-direction rotation transmission mechanism is rotatably or swingably supported in the axial groove 35 through a pivot pin 37. The ratchet lever 39 is continuously biased upward at the rear end thereof by a biasing spring 41 which is provided between the boss 31 and the rear end (left end in FIG. 1) of the ratchet lever 39, in FIG. 1. Consequently, the ratchet lever 39 is always biased to rotate in the clockwise direction about the pivot pin 37 by the spring 41 in FIG. 1. The ratchet lever 39 is provided on its front end (right end in FIG. 1) with a ratchet pawl 43 which will be discussed hereinafter.

The motor M is displaced below the rotational output shaft 27 so that the drive shaft 21 of the motor M is substantially in parallel with the axis of the rotational output shaft 27. This makes it possible to realize a compact and handy pistol-shaped flaring device.

Figure 12:
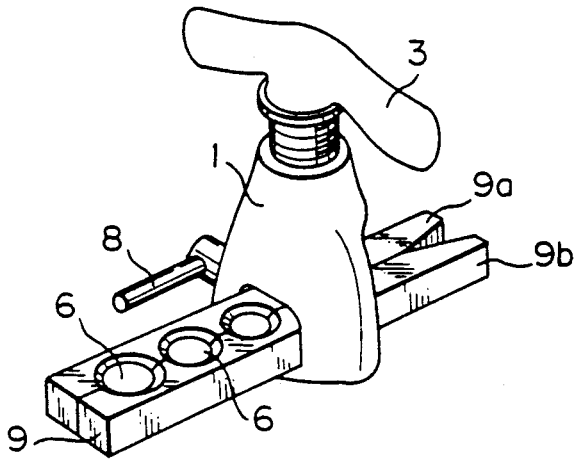
Fig. 12 PRIOR ART
FIG. 12 is a perspective view of a known manual flaring tool.
Figure 13:
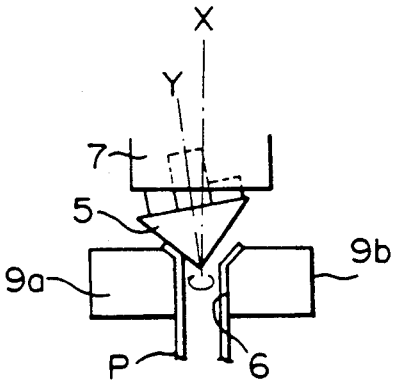
Fig. 13 PRIOR ART
FIGS. 13 and 14 are explanatory vies of an eccentric cone shown at different rotation phases thereof, for explaining how to flare a pipe end; and, FIG. 15 is a schematic view of a pipe before and after flaring.
Figure 14:
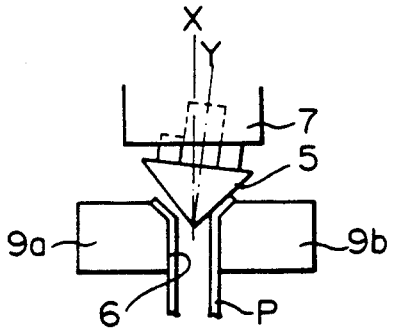
Fig. 14 PRIOR ART
Figure 15:
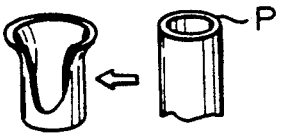

The rotational output shaft 27 is provided on its front end with an eccentric cone 47 which juts out from the body 11. The eccentric cone 47 per se is the same as that of FIGS. 12 and 13, so that it has a rotation axis Y inclined or eccentric with respect to the axis X of the rotational output shaft 27. Consequently, the rotation axis Y describes a conical generatrix when the eccentric cone 47 rotates. Note that the front end (apex of) of the eccentric cone remains at a constant position (fixed position) on the axis X of the rotational output shaft 27 during the rotation of the eccentric cone 47.

On the rotational output shaft 27 is fitted an annular feed screw shaft 49 which is rotatable and movable in the axial direction relative to the rotational output shaft 27. The feed screw shaft 49 is provided on its outer periphery with a threaded portion (male thread) 49*a* which is screw-engaged by a threaded hole (female thread) 51 of a nut member 53 integral with the body 11. Namely, the feed screw shaft (movable element) 49 and the nut member (immovable element) 53 constitute a feed screw mechanism in which when the feed screw shaft 49 rotates, it moves in the axial direction relative to the immovable nut member 53.

The rotational output shaft 27 is provided at its front end with a larger diameter portion 28. Between the larger diameter portion 28 and the feed screw shaft 49 is provided a first spring 55 which continuously biases the eccentric cone 47 in the right hand direction in FIG. 1. On the other hand, a second spring 59 which is weaker than the first spring 55 is provided in the rear end of the feed screw shaft 49 and between the rear end of the feed screw shaft 49 and the boss 31 to bias both in a direction away from one another.

The feed screw shaft 49 is provided at its rear end with a flanged projection 61 which is in turn provided, on its outer periphery, with an axially extending ratchet groove 62 (FIG. 4B) in which the ratchet pawl 32 can be engaged. Consequently, the engaging position of the ratchet pawl 43 with the axial ratchet groove 62 varies in accordance with the axial displacement of the feed screw shaft 49.

Figures 8A, 8B, 8C:
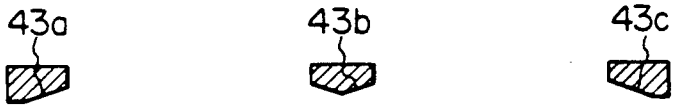
FIG. 8A to 8C are sectional views taken along the lines 8A—8A, 8B—8B and 8C—8C in FIG. 1, respectively.

The ratchet pawl 43 has a cross-sectional shape which changes in the axial direction thereof, as shown in FIGS. 8A, 8B and 8*c*. Namely, as viewed from the front (the side adjacent to the eccentric cone 47), the ratchet pawl 43 has a first tapered bottom surface 43*a* to gradually decrease the width thereof toward the right (FIG. 8A), a generally V-shaped bottom surface 43*b* (FIG. 8B) and a second tapered bottom surface 43*c* to gradually decrease the width of the ratchet pawl 43 toward the left (FIG. 8C), in this order. The inclination angle of the first tapered bottom surface 43*a*, the V-shaped bottom surface 43*b* and the second tapered bottom surface 43*c* is for example around 18°.

To the front end of the nut member 53 integral with the body 11 is detachably attached a pipe holder 71 which is adapted to attach the flaring device to a pipe P to be flared. The pipe holder 71 is shown in detail in FIGS. 9A, 9B, and 10.

The pipe holder 71 has a holder body 73, and a holder ring 75 (FIG. 1) which connects the holder body 73 to the nut member 53 of the tool body 11. The holder ring 75 is provided on its front and rear end faces with a plurality of inwardly flanged projections 77 (rear side) and 79 (front side). In the illustrated embodiment, there are three inner radial projections 77 (79) provided on each end face of the holder ring 75 and spaced from one another at a predetermined angular distance.

Figure 11:
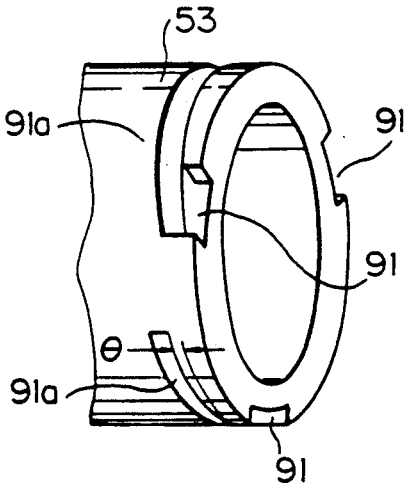
FIG. 11 is a partial perspective view of a nut member shown in FIG. 1.

The rear projections 77 are fitted in corresponding grooves 91 (FIG. 11) which are formed in the nut member 53. Each of the grooves 91 has a circumferential groove portion 91*a* which circumferentially extends from the entrance of the groove 91 and which is gradually inclined toward the rear end of the nut member 53 at a slight inclination angle $\theta$, as shown in FIG. 11. Behind the front radial projections 79 are located associated radial projections 80 of the holder body 73, so that the front end faces of the radial projections 80 come into surface contact with the rear end faces of the associated radial projections 79.

Upon assembly, the holder body 73 is opposed to the holder ring 75 in such a way that there is a difference in phase between the projections 80 of the holder body 73 and the projections 79 of the holder ring 75, so that the projections 80 are disposed between the projections 79 as viewed from the axial direction. Then, the projections 80 of the holder body 73 are axially moved in the holder ring 75, and thereafter, the holder body 73 and the holder ring 75 are relatively rotated through an appropriate angular displacement to bring the projections 80 behind the associated projections 79, whereby the holder body 73 and the holder ring 75 are integrally interconnected.

Similarly, the rear projections 77 of the holder ring 75 are first fitted in the associated grooves 91 of the nut member 53 and are then rotated, so that the projections 77 are moved in and along the circumferential inclined groove portions 91*a* of the associated grooves 90. Due to the inclination of the groove portions 91*a*, the holder ring 75 is moved in the axial direction toward the nut member 53, and accordingly, the holder body 73 is strongly urged toward the nut member 53, thus resulting in a firm connection of the nut member 53 and the pipe holder 71.

Figure 9A:
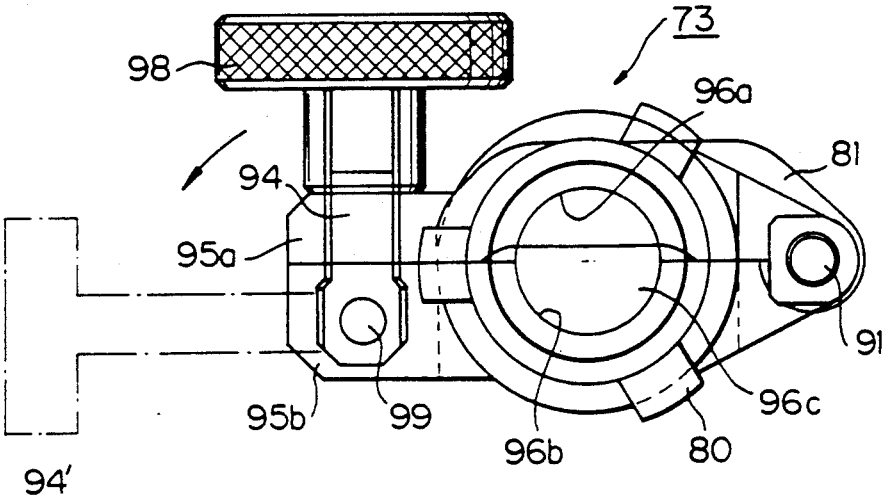
FIGS. 9A and 9B are right side elevational views of a holder shown in FIG. 1, shown at open and closed positions of a positioning plate thereof, respectively.
Figure 9B:
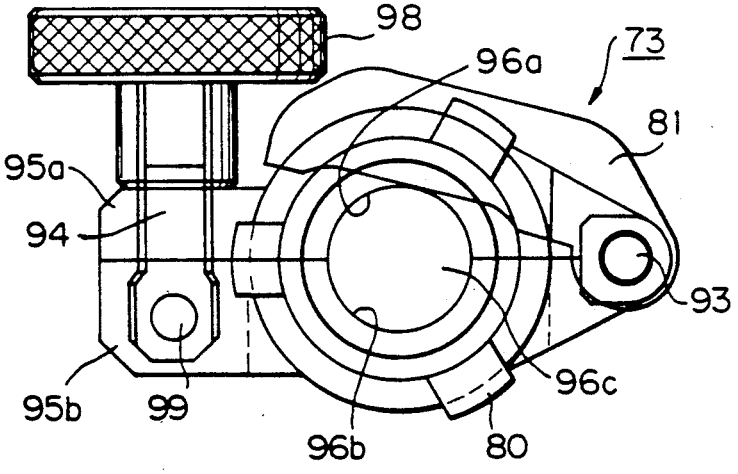

The holder body 73 has a pair of split type plates 95*a* and 95*b* which can be opened and closed, as shown in FIGS. 9A and 9B. The plates 95*a* and 95*b* are connected to each other at their one end through a pivot pin 93 so as to relatively rotate, and at their opposite ends by a fastening bolt 94 having a knurled handle 98 for opening and closing. Namely, the base end of the fastening bolt 94 is rotatably connected to the plate 95*b* through a pivot pin 99, so that when the fastening bolt 94 is rotated in the counterclockwise direction in FIG. 9A, as shown by a phantom line 94′, the other plate 95*a* is free from the fastening bolt 94. Consequently, the plates 95*a* and 95*b* can be opened to clamp the pipe P in the holder body 73 of the pipe holder 71. After the pipe P is clamped by the holder body 73, the fastening bolt 94 which is returned to a position shown at a solid line in FIG. 9A is fastened by rotating the handle 98 thereof to firmly and immovably hold the pipe P in the pipe holder 71.

The plates 95*a* and 95*b* have semi-circular openings 96*a* and 96*b* which define a circular opening 96*c* having a diameter substantially equal to the outer diameter of the pipe P when the plates 95*a* and 95*b* are closed, so that the pipe P can be fitted in the circular opening 96*c*.

Figure 10:
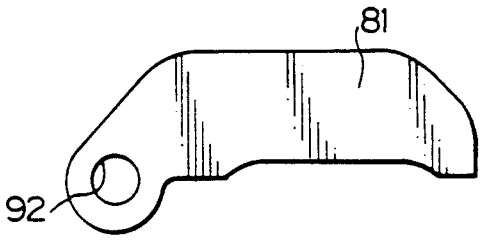
FIG. 10 is an enlarged view of a positioning plate shown in FIGS. 9A and 9B.

Preferably, the holder body 73 has a positioning plate 81 for positioning the front end of the pipe P, as shown in FIGS. 9A, 9B and 10. The positioning plate 81 restricts the axial position of the pipe P. Namely, the pipe P is inserted in the opening 96*c* of the pipe holder until the end of the pipe P to be flared comes into contact with the front side face (right side face in FIG. 1) of the positioning plate 81, as shown in FIG. 1. The positioning plate 81 has at its one end a pin hole 92 in which the pivot pin 93 of the plates 95*a* and 95*b* is fitted, so that the positioning plate 81 is rotatable or swingable about the pivot pin 93 between an open or inoperative position (FIG. 9B) and a closed or operative position (FIG. 9A). The positioning plate 81 is placed on the holder body 73 on the side thereof adjacent to the nut member 53.

The positioning plate 81 is shaped such that it covers the circular opening 96*c* defined by the semi-circular openings 96*a* and 96*b* so as not to exceed the semi-circular area, that is, so as not to cover the center of the circular opening 96*c*, at the closed position (operative position) shown in FIG. 9A. Consequently, the apex of the eccentric cone 47 can enter the inside of the pipe P which is held in the opening 96*c* of the holder plates 95*a* and 95*b* without being interrupted by the positioning plate 81, as shown in FIG. 1.

Since the eccentric cone 47 moves forward while eccentrically rotating, upon flaring, as mentioned above, the eccentric cone 47 gradually enters the inner diameter of the pipe P while kicking the positioning plate 81 every turn of rotation. Namely, the positioning plate 81 vibrates or rattles during the rotation of the eccentric cone 47. Note that if the positioning plate 81 is large enough to cover the center of the circular opening 96*c*, the positioning plate 81 interferes with the apex of the eccentric cone 47, so that the latter can not enter the pipe P. It should be appreciated that since the eccentric cone 47 eccentrically rotates, as mentioned above, once the apex thereof passes beyond the positioning plate 81, the eccentric cone 47 can thrust the positioning plate 81 aside while rotating.

The operation of the motor driven flaring device as constructed above is as follows.

Figure 4A:
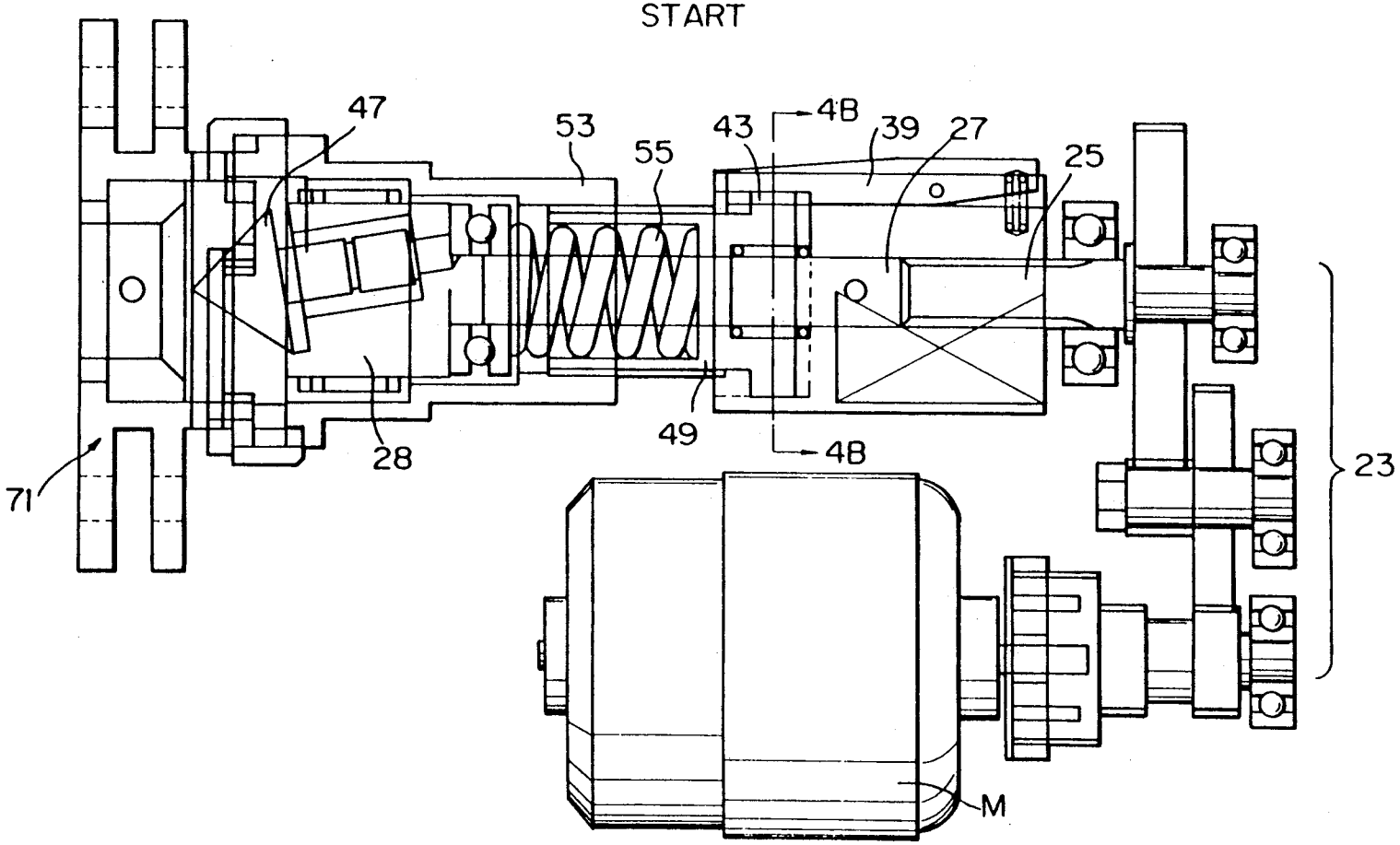
FIG. 4A is a longitudinal sectional view of a main part of a motor driven flaring device shown in FIG. 1, shown at a start position.
Figure 4B:
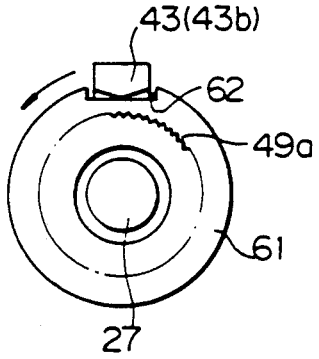
FIG. 4B is a sectional view taken along the line 4B and 4B in FIG. 4A.
Figure 5B:
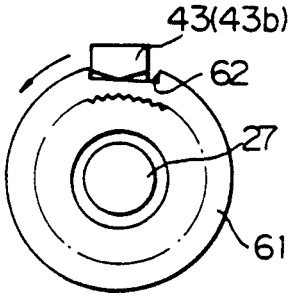
FIG. 5B is a sectional view taken along the line 5B and 5B in FIG. 5A.
Figure 5A:
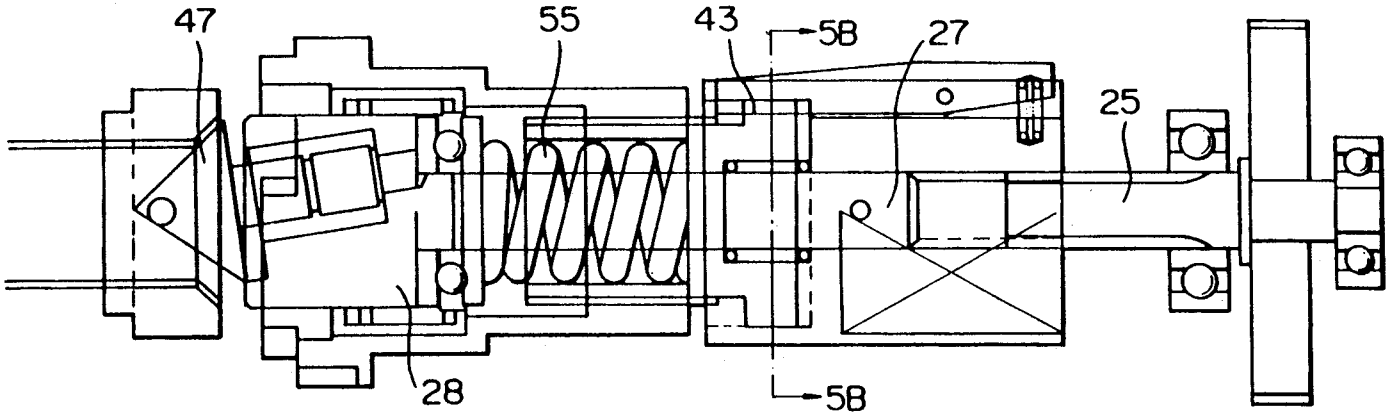
FIG. 5A is a view similar to FIG. 4A, but shown at a position of completion of the flaring.

FIGS. 4A and 4B show the flaring device at a start position. In this state, the portion of the ratchet pawl 43 that has the generally V-shaped tapered bottom 43*b* (FIG. 8B) is fitted in the axial groove 62 of the feed screw shaft 49, as shown in FIG. 4B. When the motor M is driven by the drive switch 17, the rotational output shaft 27, and accordingly, the eccentric cone 47 are rotated through the reduction gear device 23, the spline 29 and the boss 31. When the ratchet lever 39 integral with the rotational drive shaft 27 is rotated for example in the counterclockwise direction in FIG. 4B, the feed screw shaft 49 is rotated in the same direction by the one direction rotation transmission mechanism which is constituted by the ratchet pawl 43 and the axial groove 62. At that time, the ratchet pawl 43 which is a driving element comes into contact at the left side face thereof with the left side wall of the axial groove 62, as shown in FIG. 5B. As a result, the feed screw shaft (male thread) 49 which constitutes the feed screw mechanism together with the threaded hole (female thread) 51 of the nut member 53 with which the male thread engages axially moves in the right direction in FIG. 1. The axial movement of the feed screw shaft 49 in the right direction is transmitted to the rotational drive shaft 27 and the eccentric cone 47 through the first spring 55. As a result, the eccentric cone 47 axially moves while rotating to be strongly pressed against the front end of the pipe P to thereby spread (flare) the pipe end into a conical shape (FIGS. 5A and 5B).

Figure 6B:
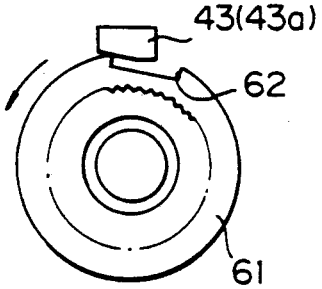
FIG. 6B is a sectional view taken along the line 6B and 6B in FIG. 6A.
Figure 6A:
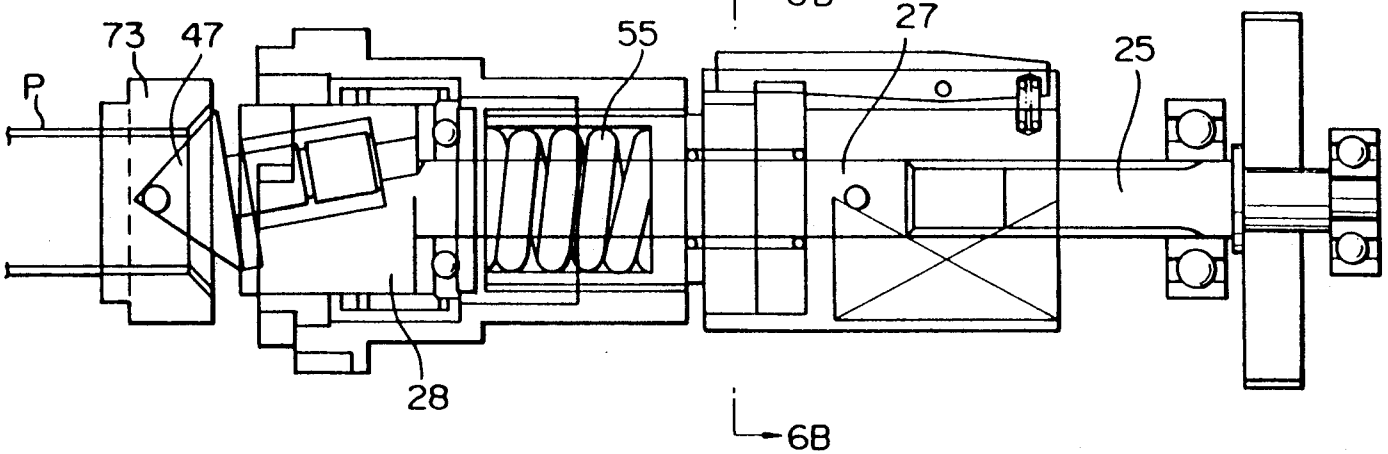
FIG. 6A is a view similar to FIG. 4A, but shown at an idling position after the completion of the flaring.

Upon completion of the flaring, the eccentric cone 47 is no longer able to move in the axial direction, so that it idle-rotates in the flared pipe end while in contact therewith. Due to a further rotation of the motor M, the feed screw shaft 49 continues moving in the axial direction while compressing the first spring 55, so that the front portion of the ratchet pawl 43 of the ratchet lever 39 that has the first tapered bottom 43*a* (FIG. 8A) comes in the axial groove 62. As a result, the ratchet pawl 43 (43*a*) idle-rotates while riding over the edge of the axial groove 62 for every one turn thereof, in view of the direction of the inclination of the ratchet pawl 43 (43*a*), as shown in FIGS. 6A and 6B. Namely, the ratchet lever 39 idle-rotates, so that no rotation thereof can be transmitted to the feed screw shaft 49. Thus, the operative connection between the rotational drive shaft 27 and the feed screw shaft 49 is broken, so that the operation of the one-direction rotation transmission mechanism becomes null. The reason to idle the eccentric cone 47 after the flaring is completed is to prevent the tool (eccentric cone) from being damaged or destroyed due to an overload which would be otherwise produced and to obtain a uniform and precisely flared end face of the pipe P.

Note that upon idling, the ratchet lever 39 repeatedly swings about the pin 37 every time the ratchet pawl 43 (43*a*) rides over the edge of the axial groove 62.

As can be understood from the foregoing, the axial groove 62 of the feed screw shaft 49 constitutes a clutch which selectively releases the one-direction rotation transmission mechanism, that is, selectively disconnects the rotational drive shaft from the feed screw shaft, in accordance with the axial position of the feed screw shaft 49 (axial groove 62).

Upon completion of the flaring, the motor M is reversed by the drive switch 17. As a result, the flaring device basically operates in a way opposite to the above-mentioned operation at the forward rotation of the motor M, but in the reverse rotation, the ratchet pawl 43 comes into contact at the right end face thereof with the right wall surface of the axial groove 62, contrary to the operation at the forward rotation. Consequently, the rotation of the ratchet lever 39 (and accordingly, the rotational drive shaft 27) is transmitted to the feed screw shaft 49. Namely, upon reversing, the ratchet pawl 43 transmits the rotation to the feed screw shaft 49.

As a result, the feed screw shaft 49 is axially moved in the left direction in FIG. 1. Note that the axial movement of the feed screw shaft 49 only takes place until the compressed first spring 55 is completely restored to its initial free state. Consequently, the ratchet pawl 43 is returned to the start position shown in FIG. 4B in which the V-shaped bottom 43*b* is placed in the axial groove 62.

Figure 7B:
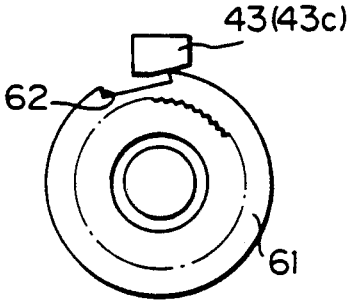
FIG. 7B is a sectional view taken along the line 7B and 7B in FIG. 7A.
Figure 7A:
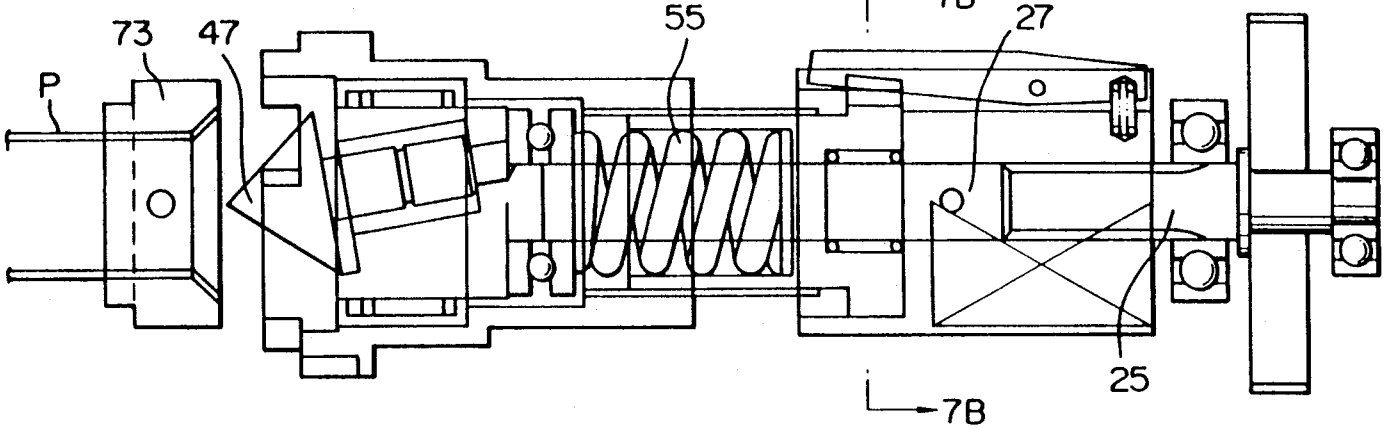
FIG. 7A is a view similar to FIG. 4A, but shown at an idling position upon reversing.

In this state, the axial movement of the feed screw shaft 49 in the left direction is transmitted to the boss 31 and the rotational drive shaft 27 through the second spring 59. As a result, the left end of the rotational drive shaft 27 comes into contact with the gear shaft 25 of the end gear W3 of the reduction gear device 23, so that no further axial movement of the rotational drive shaft 27 can occur, and accordingly, only the feed screw shaft 49 axially moves in the left direction thereafter while compressing the second spring 59. Consequently, the portion of the ratchet pawl 43 that has the rear tapered bottom 43*c* (FIG. 8C) comes in the axial groove 62. In this state, the ratchet pawl 43 (43*c*) idle-rotates while riding over the edge of the axial groove 62 for every turn, in view of the direction of the inclination of the bottom of the ratchet pawl 43, as shown in FIGS. 7A and 7B, similarly to FIGS. 6A and 6B.

Namely, the ratchet lever 39 idles, so that no rotation thereof can be transmitted to the feed screw shaft 49. That is, the functional connection of the rotational drive shaft 27 and the feed screw shaft 49 is broken. Thus, even if the motor M continues rotating, the rotational drive shaft idles to prevent the tool from being broken or damaged due to the overload.

As can be understood from the foregoing, according to the present invention, a simple flaring device having a motor incorporated therein can be realized.

Furthermore, according to the present invention, the mechanism which idles the tool (eccentric cone) upon the completion of the flaring and the retraction of the eccentric cone can prevent the tool from being damaged or broken due to the overload.

According to the flaring device of the present invention, a uniform flared surface of a good appearance can be obtained, regardless of the skill of the operator.

We claim:

1. A motor driven flaring device in which a rotatable eccentric cone an apex of which defines a fixed center of rotation is pressed, while rotating, against an end of a pipe to be flared to spread the end of the pipe into a conical shape, comprising:

a body having a motor incorporated therein and having an output shaft to be connected to a drive source, said body being provided with a female threaded portion;

a rotational drive shaft which is connected to the output shaft of the motor so as to relatively move in the axial direction thereof, said eccentric cone being rigidly secured to the rotational drive shaft;

a feed screw shaft member which is connected to the rotational drive shaft and is screw-engaged by the female threaded portion of the body so as to rotate and move in the axial direction thereof;

a one-direction rotation transmission means between the rotational drive shaft and the feed screw shaft member for transmitting the rotation of the rotational drive shaft to the feed screw shaft member only in one direction; and, an elastic means between the feed screw shaft member and the rotational drive shaft for continuously biasing the rotational drive shaft in one predetermined axial direction.

2. A motor driven flaring device according to claim 1, further comprising a reduction means between the output shaft of the motor and the rotational drive shaft for reducing and transmitting the rotation of the motor to the rotational drive shaft.

3. A motor driven flaring device according to claim 2, wherein said reduction means comprises a gear train including a plurality of gears.

4. A motor driven flaring device according to claim 1, wherein said motor is located below the rotational drive shaft so that the output shaft of the motor is substantially in parallel with the rotational drive shaft.

5. A motor driven flaring device according to claim 1, further comprising a nut member integral with the body, said female threaded portion being provided in the nut member.

6. A motor driven flaring device according to claim 5, wherein said one-direction rotation transmission means comprises a ratchet lever pivoted to the rotational drive shaft and having a ratchet pawl, and an axial ratchet groove formed in the feed screw shaft, so that the ratchet pawl can be engaged in the axial ratchet groove.

7. A motor driven flaring device according to claim 6, wherein said ratchet pawl has a bottom surface having different shapes in accordance with the axial position thereof.

8. A motor driven flaring device according to claim 7, wherein said ratchet pawl has two tapered bottom surface portions having opposite directions of inclination and a generally V-shaped intermediate bottom surface portion between the two tapered bottom surface portions.

9. A motor driven flaring device according to claim 5, further comprising a pipe holder which can be detachably attached to the body of the device to releasably hold a pipe to be flared.

10. A motor driven flaring device according to claim 9, wherein said pipe holder comprises a holder body and a holder ring which detachably mount the holder body to the nut member.

11. A motor driven flaring device according to claim 10, wherein said holder body comprises a pair of split plates, each having a semi-circular opening which defines, when combined, a circular opening in which a pipe to be flared can be held.

12. A motor driven flaring device according to claim 11, further comprising a positioning plate which is rotatably mounted to one of the split plates to restrict the axial position of a pipe to be flared in the pipe holder.

13. A motor driven flaring device according to claim 12, wherein said positioning plate lies in a plane perpendicular to the axis of a pipe to be flared over only a part of the circular opening defined by the split plates so as to expose the center thereof.

14. A motor driven flaring device according to claim 1, further comprising a clutch member which is provided between the rotational drive shaft and the feed screw shaft member to selectively disengage the connection therebetween through the one-direction rotation transmission means in accordance with the axial movement of the feed screw shaft member.

15. A motor driven flaring device according to claim 1, wherein said biasing means comprises a first spring between the rotational drive shaft and the feed screw shaft member to continuously bias the eccentric cone secured to one end of the rotational drive shaft in one direction.

16. A motor driven flaring device according to claim 15, further comprising a second spring between the rotational drive shaft and the feed screw shaft member to bias them in a direction away from each other, said second spring being weaker than the first spring.

17. A motor driven flaring device according to claim 1, wherein said body is of a pistol shape.

18. A motor driven flaring device according to claim 17, further comprising a drive switch which corresponds to a trigger of a pistol and which is actuated to drive the motor.

* * * * *